US006082152A

United States Patent [19]

Im

[11] Patent Number: 6,082,152

[45] Date of Patent: Jul. 4, 2000

[54] WASHING MACHINE HAVING A WASHING LIQUID PUMPING APPARATUS

[75] Inventor: Jang-Yun Im, Kwangju, Rep. of Korea

[73] Assignee: Daewoo Electronics Co., Ltd., Seoul, Rep. of Korea

[21] Appl. No.: 09/062,705

[22] Filed: Apr. 20, 1998

[30] Foreign Application Priority Data

May 29, 1997 [KR] Rep. of Korea ..... 97-21793

[51] Int. Cl.[7] ..... D06F 17/00; D06F 23/04

[52] U.S. Cl. ..... 68/23.7; 68/53; 68/133; 68/134; 68/184

[58] Field of Search ..... 68/23.5, 23.6, 68/23.7, 53, 131, 133, 134, 184

[56] References Cited

U.S. PATENT DOCUMENTS

| | | | |
|---|---|---|---|
| 4,402,198 | 9/1983 | Cartier | 68/53 X |
| 5,746,071 | 5/1998 | Youn | 68/133 X |
| 5,829,276 | 11/1998 | Suh et al. | 68/53 |

FOREIGN PATENT DOCUMENTS

| | | | |
|---|---|---|---|
| 229276 | 10/1996 | Japan | 68/53 |

*Primary Examiner*—Philip R. Coe

*Attorney, Agent, or Firm*—Pillsbury Madison & Sutro LLP

[57] ABSTRACT

A washing machine pumps a washing liquid towards an upper portion of a spin tub while a washing cycle is being executed. The washing machine has a pumping unit disposed at an underside of an outer tub so as to pump the washing liquid from a bottom wall of the outer tub to upper portions of the spin tub and the outer tub. The pumping unit has a receptacle which is fixed to the underside of the outer tub, a disc member which is reciprocated in upward and downward directions within the receptacle, a wire having a first end fixed to a center of an underside of the disc member, a synchronous motor connected to a second end of the wire for pulling the disc member downward, and a compression spring installed in the receptacle for upwardly biasing the disc member. The washing machine pumps the washing liquid toward the upper portion of the spin tub while the washing cycle is being executed, so the turbulent liquid flow is created in the spin tub and thereby preventing the articles from tangling with each other, and improving the washing effect.

12 Claims, 5 Drawing Sheets

WASHING MACHINE HAVING A WASHING LIQUID PUMPING APPARATUS

BACKGROUND OF THE INVENTION

1. Field of the Invention

The present invention relates to a washing machine, and more particularly to a washing machine which pumps a washing liquid towards an upper portion of a spin tub while a washing cycle is being executed, thereby generating a turbulent flow in the spin tub.

2. Prior Arts

Generally, a washing machine is an appliance for separating dirt from articles to be washed such as clothing by sequentially carrying out various cycles in the order of liquid feeding, washing, rinsing, dehydrating, and draining cycles.

While the above cycles are being executed, dirt contained in the articles separates from the articles by means of detergents or by means of friction between the washing liquid and the articles.

However, in conventional washing machines, concentric swirl-shaped liquid flows are generated in a spin tub, so the articles flowing along the concentric swirl-shaped liquid flows become tangled with each other. In addition, the swirl-shaped liquid flows generated from a bottom of the spin tub become weak as they reach an upper portion of the spin tub due to an interference by the articles. For this reason, the washing effect at the upper portion of the spin tub is reduced.

In order to solve the above problem, another conventional washing machine which pumps a washing liquid toward an upper portion of a spin tub while a washing cycle is being executed, thereby preventing the articles from tangling and improving the washing effect, is suggested. U.S. Pat. No. 4,402,198 issued to Cartier discloses one such washing machine.

FIGS. 4 and 5 show Cartier's washing machine 10.

As shown in FIG. 4, Cartier's washing machine 10 includes a cabinet 12. Cabinet 12 has a top 14 with a lid 16 and a console 18 having presettable controls 20 thereon. Lid 16 in top 14 of cabinet 12 permits access into an outer tub 22. Enclosed and supported within outer tub 22 is a spin tub 24 in which an agitator 25 is mounted.

Below outer tub 22, but within cabinet 12, there is provided an electric motor 28 which oscillatably drives agitator 26 through a transmission 30.

FIG. 5 is a sectional view showing an internal structure of agitator 26. As shown in FIG. 5, agitator 26 has a skirt portion 32 near the bottom thereof and a substantially vertical barrel portion 34 integrally connected with skirt portion 32 and projecting upwardly therefrom. A plurality of vanes 36 are provided around a periphery of barrel 34. Vanes 36 extend downwardly and outwardly along skirt portion 32 of agitator 26.

Agitator 26 is of a two-wall construction having an outer wall 40 and a radially inwardly spaced inner wall 41. An annular space 46 is formed between outer wall 40 and inner wall 41. In addition, a channel 42, into which the washing liquid is introduced when agitator 26 rotates, is formed in skirt portion 32.

A chamber 58 is formed at an upper portion of barrel portion 34. A filtering means 60 is detachably secured within chamber 58. Chamber 58 communicates with annular space 46 by an opening 72. In addition, a plurality of apertures 76 are provided at a terminal end of vertical barrel 34.

In a washing cycle, when a user pushes controls 20 installed on console table 18, a microcomputer (not shown) accommodated in washing machine 10 sends an operating signal to electric motor 28 so that electric motor 28 rotates. The rotational force of electric motor 28 is transferred to agitator 26 through transmission 30, so agitator 26 rotates.

As agitator 26 rotates, the washing liquid is introduced through channel 42 formed in skirt portion 32 into annular space 46 formed between outer wall 30 and inner wall 41.

As agitator 26 continues to rotate, the washing liquid flows into chamber 58 through opening 72. Then, the washing liquid which has flowed into chamber 58 passes through filtering means 60 and pumps towards the upper portion of outer tub 22 through apertures 76 formed at the distal end of vertical barrel 34.

In this manner, Cartier's washing machine 10 pumps the washing liquid towards the upper portion of outer tub 22, so a turbulent liquid flow is generated in outer tub 22 and thereby, the washing effect is improved.

However, in Cartier's washing machine 10, agitator 26 has a complicated structure, so the manufacturing of agitator 26 is very difficult.

Further, since the washing liquid pumps towards the upper portion of outer tub 22 through relatively small apertures 76, the washing liquid does not strongly collide with the articles. For this reason, the washing efficiency is relatively reduced.

SUMMARY OF THE INVENTION

The present invention has been made to overcome the above described problems of the prior arts, and accordingly it is an object of the present invention to provide a washing machine which can pump the washing liquid towards an upper portion of a spin tub or an outer tub so as to generate a turbulent liquid flow in the spin tub, thereby preventing the articles to be washed from tangling with each other and improving the washing efficiency.

To achieve the above object, the present invention provides a washing machine comprising:

- a housing;
- an outer tub disposed in the housing so as to receive a washing liquid;
- a spin tub accommodated in the outer tub, the spin tub having a plurality of discharging holes at a side wall thereof;
- a first motor for generating a rotational force;
- a pulsator mounted at a lower portion of the spin tub for generating a swirl shaped liquid flow in the spin tub;
- a power transmission for driving the pulsator or the pulsator by receiving the rotational force from the motor; and
- a means for pumping the washing liquid from a bottom wall of the outer tub to upper portions of the spin tub and the outer tub, the pumping means being disposed at an underside of the outer tub.

According to the preferred embodiment of the present invention, the spin tub is formed at a bottom wall thereof with an opening communicated with the outer tub.

The outer tub is formed at a brink of the bottom wall thereof with five holes which are regularly spaced at an angle of 72 degrees apart from each other. The pumping means is provided at positions corresponding to five holes.

The pumping means includes a pumping unit having a receptacle which is fixed to the underside of the outer tub, a disc member which is reciprocated in upward and downward directions within the receptacle, a wire having a first end fixed to a center of an underside of the disc member, a second motor connected to a second end of the wire for pulling the disc member downward, and an elastic member installed in the receptacle for upwardly biasing the disc member.

The second motor includes a reversible motor having a rotation shaft. The wire is wound around the rotation shaft when the rotation shaft of the second motor rotates in a forward direction thereby pulling the disc member downward. The wire is released from the rotation shaft when the rotation shaft of the second motor rotates in a reverse direction. The elastic member includes a compression spring.

When a user pushes an operating button installed on a control panel, the washing liquid is introduced from a liquid source into the outer tub. When the liquid level in the outer tub reaches the predetermined liquid level, the supply of the washing liquid stops. At the same time, a microcomputer applies an electric signal to the first motor, so a motor shaft of the motor rotates in the forward and reverse directions, so that the pulsator rotates in the forward and reverse directions, thereby washing the articles.

At the same time, the microcomputer applies an electric signal to the second motor, so the rotation shaft of the second motor rotates in the forward and reverse directions. When the rotation shaft of the second motor rotates in the forward direction, the wire is wound around the rotation shaft so that the disc member is downwardly moved toward the bottom wall of the receptacle.

In addition, when the rotation shaft of the second motor rotates in the reverse direction, the wire is released from the rotation shaft so that the disc member is upwardly moved by the biasing force of the elastic member. At this time, some of washing liquid received in the receptacle is pumped by the disc member towards the upper portions of the outer tub and the spin tub.

The washing liquid introduced into the spin tub by the pumping unit collides with the swirl shaped liquid flow generated by the pulsator, so that a turbulent liquid flow is created in the spin tub, and thereby preventing the articles from tangling with each other.

In addition, the washing liquid pumped towards the upper portion of the spin tub collides with articles, thereby improving the washing effect.

BRIEF DESCRIPTION OF THE DRAWINGS

The above object and other advantages of the present invention will become more apparent by describing in detail a preferred embodiment with reference to the attached drawings, in which.

DESCRIPTION OF THE PREFERRED EMBODIMENTS

Hereinafter, a preferred embodiment of the present invention will be described in detail with reference to the accompanying drawings.

Figure 1:
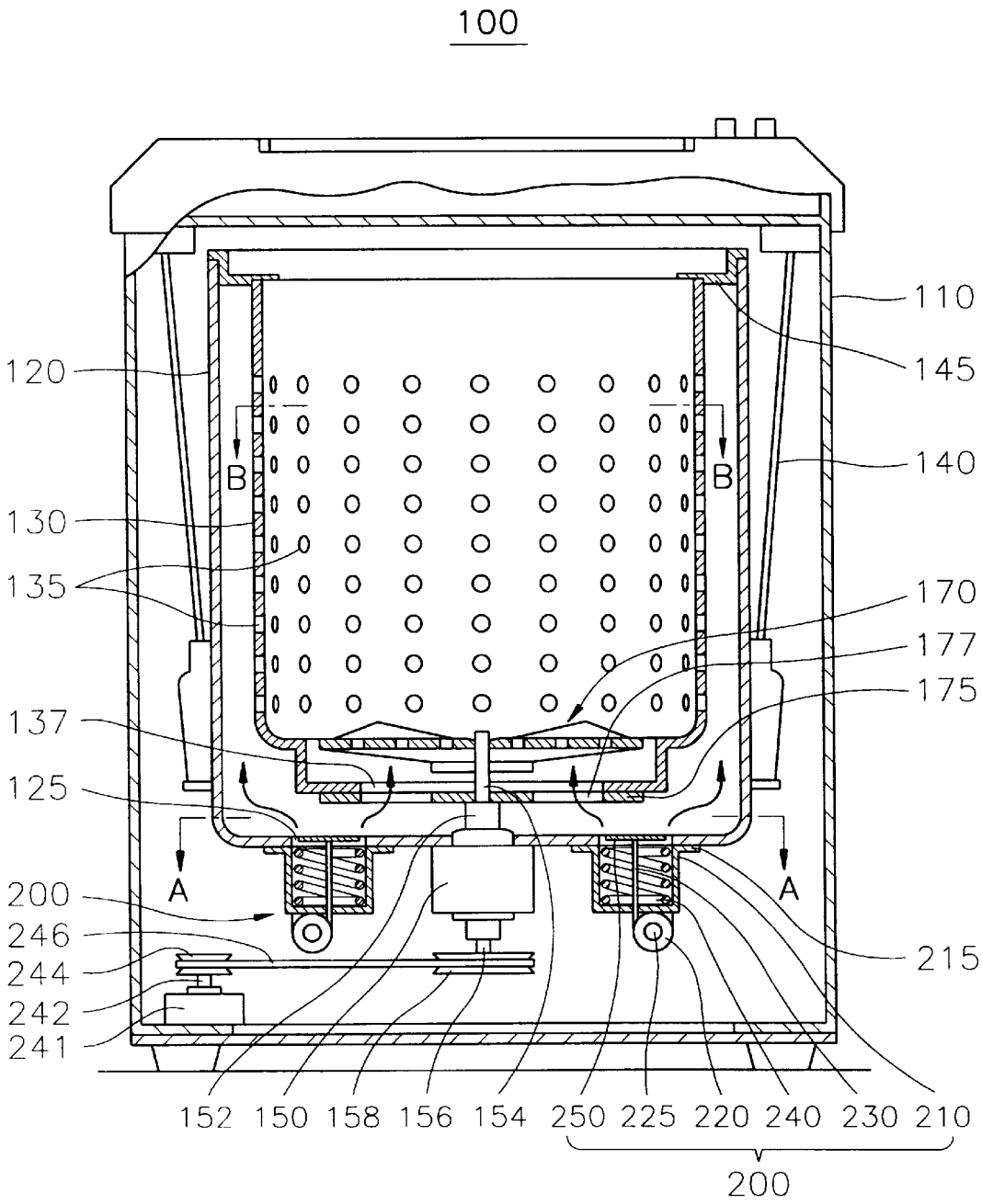
FIG. 1 is a sectional view showing the structure of a washing machine according to one embodiment of the present invention.

FIG. 1 shows a washing machine 100 according to one embodiment of the present invention.

As shown in FIG. 1, washing machine 100 has a housing 110. An outer tub 120 is disposed in housing 110 so as to receive a washing liquid, and a spin tub 130 is accommodated in outer tub 120. Spin tub 130 is formed at its side wall with a plurality of discharging pores 135. Spin tub 130 is formed at a bottom wall thereof with an opening 137 which is communicated with outer tub 120. Outer tub 120 is formed at a bottom wall thereof with a plurality of holes 125.

Figure 2:
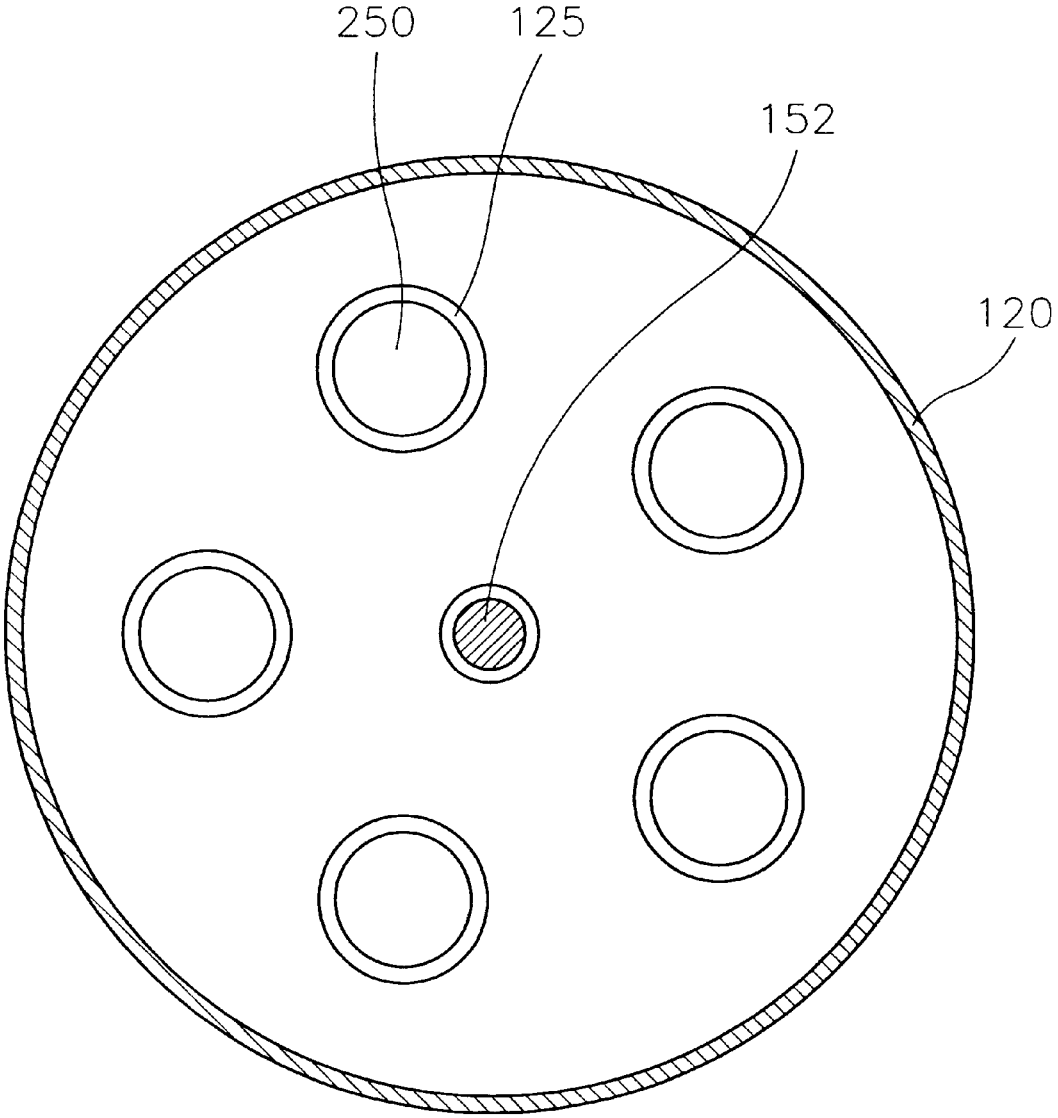
FIG. 2 is a sectional view taken along line A—A in FIG. 1.

As shown in FIG. 2, outer tub 120 is preferably formed at a brink of the bottom wall thereof with five holes 125 which are regularly spaced at an angle of 72 degrees apart from each other.

Referring again to FIG. 1, a plurality of pumping units 200 for pumping the washing liquid from the bottom wall of outer tub 120 to upper portions of outer tub and spin tub 120 and 130 are disposed at an underside of outer tub 120. Preferably, each pumping unit 200 is provided below each of five holes 125, respectively. Since pumping units 200 have the same structure with each other, the structure thereof will be described below in relation to one of them.

Pumping unit 200 has a receptacle 210 which is fixed to the underside of outer tub 120, a disc member 250 which is reciprocated in upward and downward directions within receptacle 210, a wire 230 having a first end fixed to a center of an underside of disc member 250, a synchronous motor 220 connected to a second end of wire 230 for pulling disc member 250 downward, and an elastic member 240 installed in receptacle 210 for upwardly biasing disc member 250.

Receptacle 210 is communicated with holes 125 formed at the bottom wall of outer tub 120 so as to receive the washing liquid therein. Receptacle 210 has a cylindrical shape and is formed at an upper portion thereof with a ridge portion 215 which is fixed to the underside of outer tub 120.

Synchronous motor 220 includes a reversible motor having a rotation shaft 225. When rotation shaft 225 of synchronous motor 220 rotates in a forward direction, wire 230 is wound around rotation shaft 225 so that disc member 250 is downwardly moved toward the bottom wall of receptacle 210. In addition, when rotation shaft 225 of synchronous motor 220 rotates in a reverse direction, wire 230 is released from rotation shaft 225 so that disc member 250 is upwardly moved by means of elastic member 240. Elastic member 240 includes a compression spring.

Synchronous motor 220 is installed below receptacle 210 and the second end of wire 230 is connected to rotation shaft 225 of synchronous motor 220 by passing through the bottom wall of receptacle 210.

In addition, disc member 250 is mounted on elastic member 240 and is horizontally disposed with respect to the bottom wall of receptacle 210. In order to facilitate the reciprocating movement of disc member 250 within receptacle 210, the diameter of disc member 250 is smaller than an inner diameter of receptacle 210. In addition, the diameter of each hole 125 is identical to the inner diameter of receptacle 210. In this case, the washing liquid received in receptacle 210 is effectively pumped towards the upper portions of outer tub 120 and spin tub 130.

Figure 3:
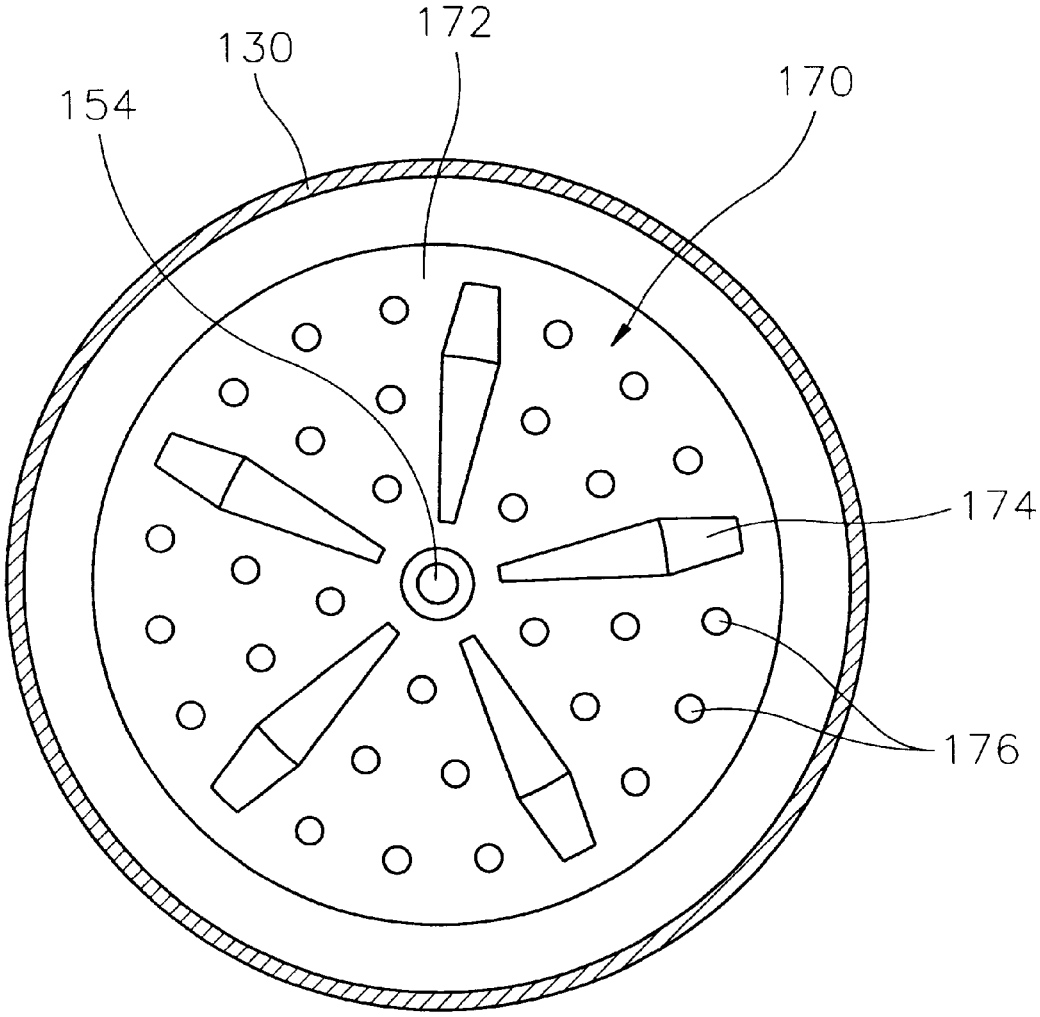
FIG. 3 is a sectional view taken along line B—B in FIG. 1.
Figure 4:
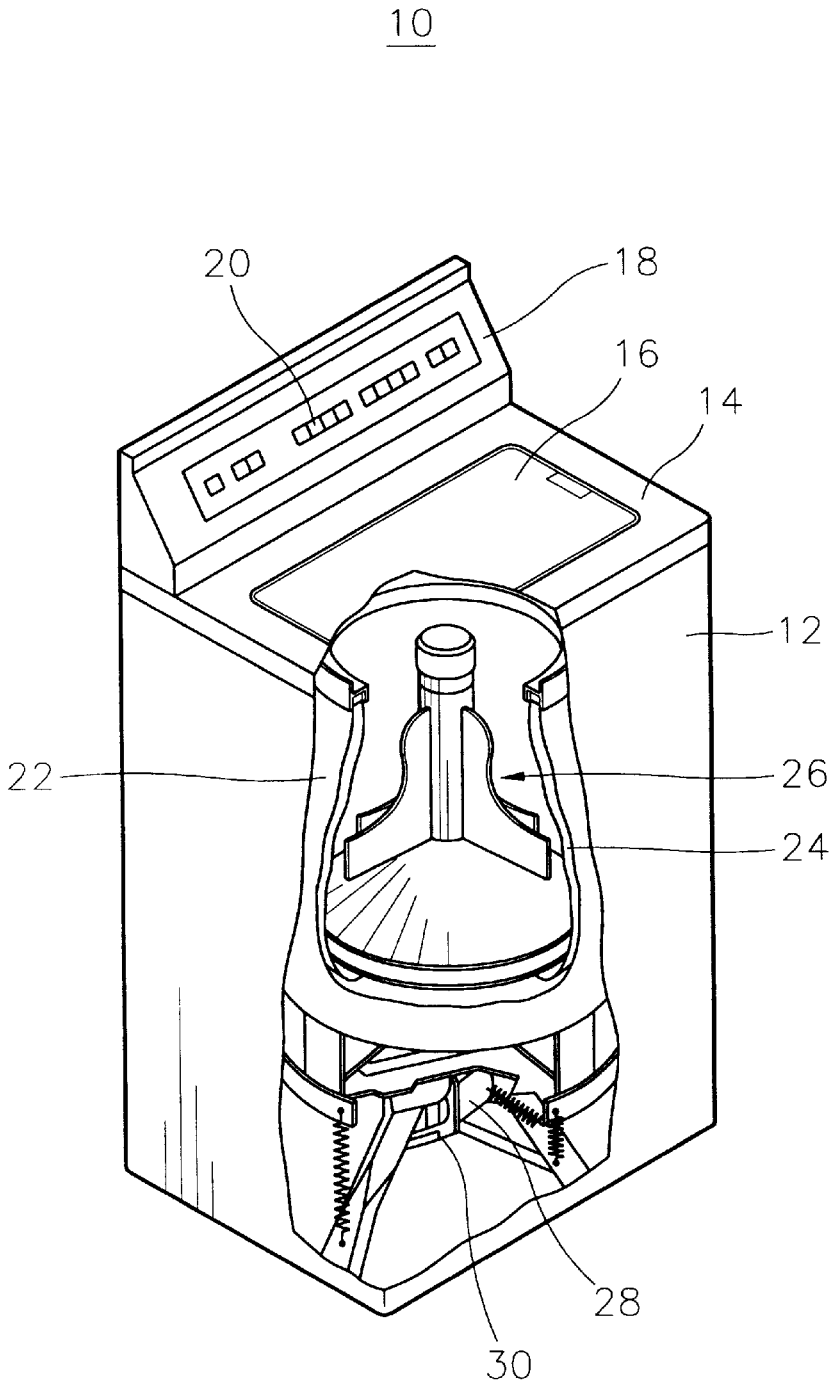
FIG. 4 (PRIOR ART)
FIG. 4 is a sectional view showing a structure of a conventional washing machine.
Figure 5:
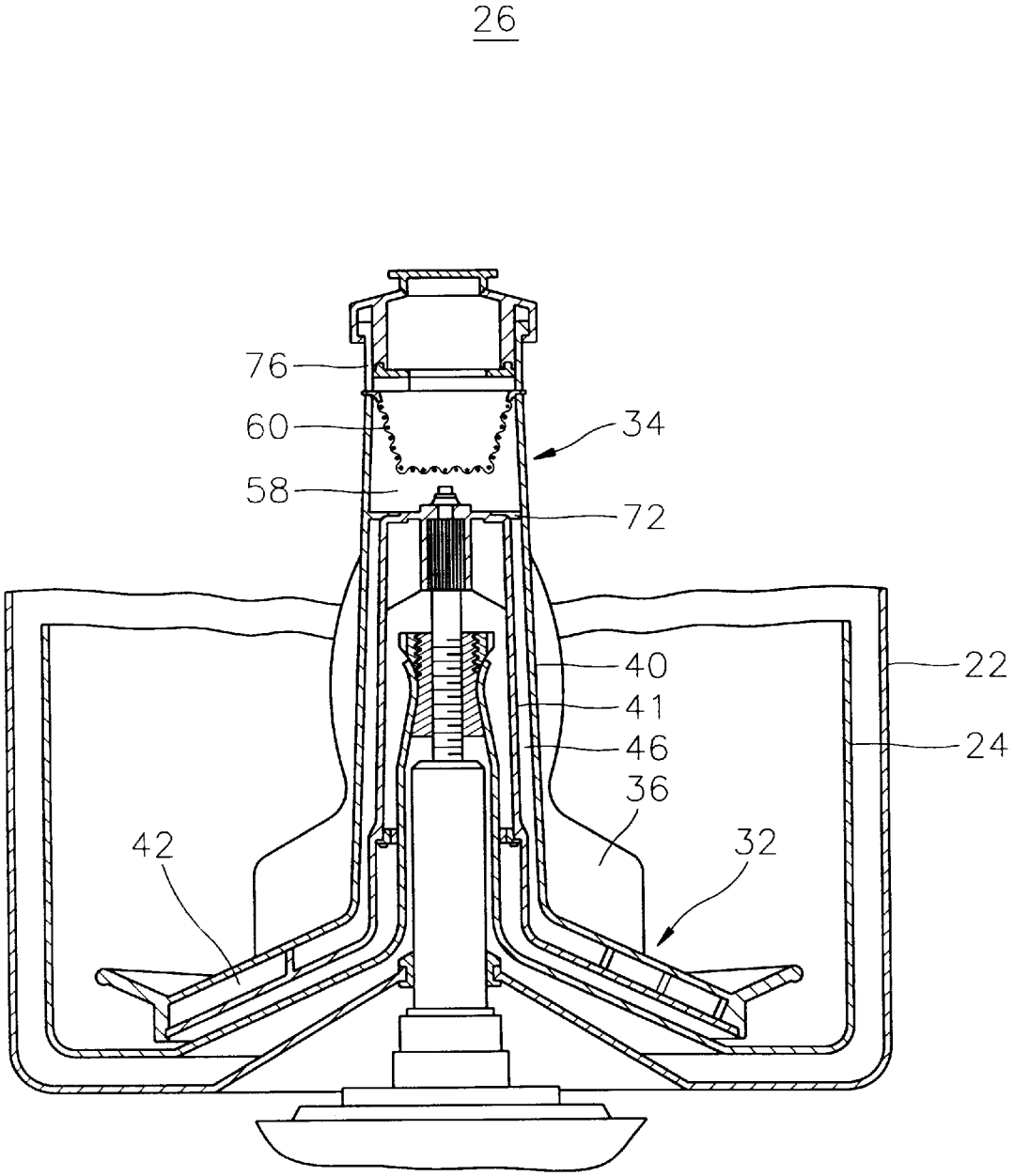
FIG. 5 (PRIOR ART)
FIG. 5 is a sectional view showing an internal structure of an agitator shown in FIG. 4.

On the other hand, a pulsator 170 for generating a swirl-shaped liquid flow in spin tub 120 is installed at a lower portion of spin tub 120. As shown in FIG. 3, pulsator 170 has a disc-shaped body 172 and a plurality of blades 174 which are installed on the upper surface of disc-shaped body 172. Disc-shaped body 172 is formed with a plurality of perforations 176 for allowing the washing liquid pumped by pumping unit 200 to flow into the upper porion of spin tub 130.

Disposed below outer tub 120 are a motor 241, which generates a rotational force for operating washing machine 100, and a transmission 150, which receives the rotational force from motor 241 and then transmits the rotational force to spin tub 130 or to pulsator 170. According to a preferred embodiment of the present invention, motor 241 includes a reversible motor.

When a washing cycle is being executed, transmission 150 transmits the rotational force of motor 241 to pulsator 170 through a pulsator driving shaft 154. In addition, when a dehydrating cycle is being executed, transmission 150 transmits the rotational force of motor 241 to spin tub 130 through a connection member 152 and rotating plate 175 fixedly coupled to the underside of spin tub 130. Rotating plate 175 has an opening 177 for allowing the fluid-communication between outer tub 120 and spin tub 130.

Motor 241 has a motor shaft 242 which is formed at its upper end with a first pulley 244. Transmission 150 has a rotating shaft 156 which is formed at its lower end with a second pulley 158. Second pulley 158 is connected to first pulley 244 by a belt 246 in such a manner that the rotational force of motor 241 can be transmitted to transmission 150.

Reference number 140 is a vibration damping device which buffs the vibration generated by the high-speed revolution of spin tub 130, thereby reducing the noise. Reference number 145 is a spraying nozzle assembly which strongly sprays the washing liquid onto the articles.

Washing machine 100 having the construction as described above operates as follows.

Firstly, when a user pushes an operating button installed on a control panel, the washing liquid is introduced from a liquid source into outer tub 120 until a liquid level in outer tub 120 reaches a predetermined level.

Then, when the liquid level in outer tub 120 reaches the predetermined liquid level, a liquid feed control valve blocks a liquid feeding pipe, so the supply of the washing liquid stops. At the same time, a microcomputer applies an electric signal to motor 241, so motor shaft 242 of motor 241 rotates in the forward and reverse directions. The rotational force of motor 241 is transmitted to pulsator 170 by way of transmission 150 and pulsator driving shaft 154. As a result, pulsator 170 rotates in the forward and reverse directions, thereby washing the articles.

At the same time, the microcomputer applies an electric signal to each synchronous motor 220, so rotation shaft 225 of each synchronous motor 220 rotates in the forward and reverse directions. When rotation shaft 225 of synchronous motor 220 rotates in the forward direction, wire 230 is wound around rotation shaft 225 so that disc member 250 is downwardly moved toward the bottom wall of receptacle 210 while overcoming the biasing force of elastic member 240. At this time, elastic member 240 is maintained in its compressed state.

In addition, when rotation shaft 225 of synchronous motor 220 rotates in the reverse direction, wire 230 is released from rotation shaft 225 so that disc member 250 is upwardly moved by the biasing force of elastic member 240. At this time, some of the washing liquid received in receptacle 210 is pumped by disc member 250 towards the upper portions of outer tub 120 and spin tub 130.

The pumped washing liquid is introduced into spin tub 130 through pores 135 of spin tub 130 or through opening 137 formed at the bottom wall of spin tub 130 as shown by arrows in FIG. 1.

The washing liquid introduced into spin tub 130 by pumping unit 200 collides with the swirl shaped liquid flow generated by pulsator 170, so that a turbulent liquid flow is created in spin tub 130, and thereby preventing the articles from tangling with each other. In addition, the washing liquid which has been pumped towards the upper portion of spin tub 130 also collides with articles floating in the upper portion of spin tub 130, thereby improving the washing effect at the upper portion of spin tub 130.

While the washing cycle is being executed, a circulation pump compresses the washing liquid and circulates the washing liquid into spraying nozzle assembly 145 mounted on the upper portion of outer tub 120. Then, the washing liquid is strongly sprayed into spin tub 130 by spraying nozzle assembly 145, so the washing effect is further improved.

As described above, the washing machine of the present invention can pump the washing liquid toward the upper portion of the spin tub while the washing cycle is being executed, so the turbulent liquid flow is created in the spin tub and thereby the articles are prevented from tangling with each other.

In addition, the washing liquid pumped towards the upper portion of the spin tub collides with articles, thereby improving the washing effect.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A washing machine comprising:

a housing;

an outer tub disposed in the housing so as to receive a washing liquid;

a spin tub accommodated in the outer tub, the spin tub having a plurality of discharging holes at a side wall thereof;

a first motor for generating a rotational force;

a pulsator mounted at a lower portion of the spin tub for generating a swirl shaped liquid flow in the spin tub;

a power transmission for driving at least one of the pulsator and the spin tub by receiving the rotational force from the motor; and a plurality of means for pumping the washing liquid from a bottom wall of the outer tub to upper portions of the spin tub and the outer tub, each of the pumping means being disposed at an underside of the outer tub, wherein the outer tub is formed at a brink of the bottom wall thereof with five holes which are regularly spaced at an angle of 72 degrees apart from each other, one of the pumping means being respectively provided for each of the holes.

2. The washing machine as claimed in claim 1, wherein the spin tub is formed at a bottom wall thereof with an opening for allowing the washing liquid pumped by the pumping means to flow into the spin tub, the spin tub being communicated with the outer tub through the opening.

3. The washing machine as claimed in claim 2, wherein the pulsator is formed with a plurality of through holes for allowing the washing liquid introduced into the spin tub to flow towards the upper portion of the spin tub.

4. The washing machine as claimed in claim 1, wherein the outer tub is formed at the bottom wall thereof with a plurality of holes, the pumping means being provided at positions corresponding to the plurality of holes.

5. The washing machine as claimed in claim 1, wherein each pumping means includes a pumping unit having a receptacle which is fixed to the underside of the outer tub, a disc member which is reciprocated in upward and downward directions within the receptacle, a wire having a first end fixed to a center of an underside of the disc member, a second motor connected to a second end of the wire for pulling the disc member downward, and an elastic member installed in the receptacle for upwardly biasing the disc member.

6. The washing machine as claimed in claim 5, wherein the receptacle is communicated with the holes formed at the bottom wall of the outer tub so as to receive the washing liquid therein.

7. The washing machine as claimed in claim 5, wherein the second motor includes a reversible motor having a rotation shaft, the wire being wound around the rotation shaft when the rotation shaft of the second motor rotates in a forward direction thereby pulling the disc member downward, the wire being released from the rotation shaft when the rotation shaft of the second motor rotates in a backward direction.

8. The washing machine as claimed in claim 7, wherein the second motor includes a synchronous motor.

9. The washing machine as claimed in claim 8, wherein a diameter of each hole is identical to an inner diameter of the receptacle.

10. The washing machine as claimed in claim 5, wherein the elastic member includes a compression spring.

11. The washing machine as claimed in claim 5, wherein the receptacle has a cylindrical shape and is formed at an upper portion thereof with a ridge portion which is fixed to the underside of the outer tub.

12. The washing machine as claimed in claim 11, wherein the disc member is horizontally installed with respect to a bottom wall of the receptacle and has a diameter smaller than an inner diameter of the receptacle.

* * * * *